US006376758B1

(12) United States Patent
Yamada et al.

(10) Patent No.: US 6,376,758 B1
(45) Date of Patent: Apr. 23, 2002

(54) ELECTRONIC SCORE TRACKING MUSICAL INSTRUMENT

(75) Inventors: Nobuhiro Yamada; Kazuhiko Matsuoka, both of Osaka (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 09/697,640

(22) Filed: Oct. 27, 2000

(30) Foreign Application Priority Data

Oct. 28, 1999 (JP) ..... 11-306639

(51) Int. Cl.[7] ..... G10H 7/00

(52) U.S. Cl. ..... 84/612; 84/610; 84/634; 84/636; 84/668

(58) Field of Search ..... 84/600–606, 609–612, 84/634–636, 649–652, 666–668

(56) References Cited

U.S. PATENT DOCUMENTS

| | | | | |
|---|---|---|---|---|
| 3,522,358 A | 7/1970 | Cambell | 84/1.03 |
| 3,946,504 A | 3/1976 | Kakano | 35/35 C |
| 4,341,140 A | 7/1982 | Ishida | 84/1.03 |
| 4,471,163 A | 9/1984 | Donald et al. | 178/22.08 |
| 4,484,507 A | 11/1984 | Nakada et al. | 84/1.03 |
| 4,485,716 A | 12/1984 | Koike | 84/1.03 |
| 4,506,580 A | 3/1985 | Koike | 84/1.01 |
| 4,562,306 A | 12/1985 | Chou et al. | 178/22.08 |
| 4,593,353 A | 6/1986 | Pickholtz | 364/200 |
| 4,602,544 A | 7/1986 | Yamada et al. | 84/1.01 |
| 4,621,321 A | 11/1986 | Boebert et al. | 364/200 |
| 4,630,518 A | 12/1986 | Usami | 84/1.03 |
| 4,651,612 A | 3/1987 | Matsumoto | 84/1.03 |
| 4,685,055 A | 8/1987 | Thomas | 364/200 |
| 4,688,169 A | 8/1987 | Joshi | 364/200 |
| 4,740,890 A | 4/1988 | William | 364/200 |
| 4,745,836 A | 5/1988 | Dannenberg | 84/1.03 |
| 4,805,217 A | 2/1989 | Morihiro et al. | 381/35 |
| 4,876,937 A | 10/1989 | Suzuki | 84/612 |

(List continued on next page.)

FOREIGN PATENT DOCUMENTS

| | | |
|---|---|---|
| EP | 0 488 732 A2 | 11/1991 |
| EP | WO 98/58364 | 12/1998 |
| JP | 7-261751 | 10/1995 |

OTHER PUBLICATIONS

Tod Machover and Joseph Chung, *Hyperinstruments Musically Intelligent/Interactive Performance and Creativity Systems*, 1988, pp. 1–41.

Robert Rowe, *Implenenting Real–Time Musical Intelligence*, 1989, pp. 1–34.

Deta S. Davis, The Computer Music and Digital Audio Series vol. 10 *Computer Applications In Music A Bibliography Supplement 1*, pp. 151, 230, 276, and 561.

*Primary Examiner*—Marlon T. Fletcher
(74) *Attorney, Agent, or Firm*—Foley & Lardner

(57) ABSTRACT

Embodiments of the present invention comprise an electronic system by which it is possible to have an accompaniment that automatically tracks the performance tempo of a performer. The system is equipped with a ROM in which a sequence of performance data that comprise a main performance composition that is to be performed by the performer is stored. The system receives input from the performer, for example, keystrokes of a keyboard, and the relative performance tempo of the performance by the performer is calculated with respect to a segment of the performance. An accompaniment is then generated by the system by comparing the detected tempo of the performance of the artist with the tempo of the reference performance that is stored in ROM. By knowing the difference in tempo between the reference piece stored in ROM and the piece as being performed by the performer, the system may then adjust the tempo of the accompaniment to match the tempo of the performance by the artist.

27 Claims, 8 Drawing Sheets

U.S. PATENT DOCUMENTS 5,034,980 A 7/1991 Kubota ..... 380/4
5,056,009 A 10/1991 Mizuta ..... 364/200
5,113,518 A 5/1992 Durst, Jr. et al. ..... 395/550
5,131,091 A 7/1992 Mizuta ..... 395/725
5,153,593 A 10/1992 Walden et al. ..... 341/143
5,177,311 A 1/1993 Suzuki et al. ..... 84/600
5,192,823 A 3/1993 Suzuki et al. ..... 84/600
5,194,682 A 3/1993 Okamura et al. ..... 84/625
5,298,672 A 3/1994 Gallitzendorfer ..... 84/603
5,305,004 A 4/1994 Fattaruso ..... 341/120
5,315,057 A 5/1994 Land et al. ..... 84/601
5,315,060 A 5/1994 Paroutaud ..... 84/726
5,315,911 A 5/1994 Ochi ..... 84/477 R
5,347,083 A 9/1994 Suzuki et al. ..... 84/613
5,347,478 A 9/1994 Suzuki et al. ..... 364/715.02
5,350,881 A 9/1994 Kashio et al. ..... 84/622
5,357,045 A 10/1994 Tabei ..... 84/603
5,412,152 A 5/1995 Kageyama et al. ..... 84/607
5,455,378 A 10/1995 Paulson et al. ..... 84/610
5,466,882 A 11/1995 Lee ..... 84/603
5,471,009 A 11/1995 Oba et al. ..... 84/645
5,491,751 A 2/1996 Paulson et al. ..... 380/25
5,499,316 A 3/1996 Sudoh et al. ..... 395/2.79
5,511,000 A 4/1996 Kaloi et al. ..... 364/514 A
5,511,053 A * 4/1996 Jae-Chang ..... 84/612
5,521,323 A 5/1996 Paulson et al. ..... 84/610
5,521,324 A 5/1996 Dannenberg et al. ..... 84/612
5,570,424 A 10/1996 Araya et al. ..... 381/61
5,585,585 A 12/1996 Paulson et al. ..... 84/610
5,611,018 A 3/1997 Tanaka et al. ..... 395/2.24
5,619,004 A 4/1997 Dame ..... 811/616
5,629,491 A * 5/1997 Usa ..... 84/636
5,641,926 A 6/1997 Gibson et al. ..... 84/603
5,648,627 A 7/1997 Usa ..... 84/600
5,675,709 A 10/1997 Chiba ..... 395/2.87
5,693,903 A 12/1997 Heidorn et al. ..... 84/668
5,708,433 A 1/1998 Craven ..... 341/144
5,712,635 A 1/1998 Wilson et al. ..... 341/144
5,713,021 A 1/1998 Kondo et al. ..... 395/614
5,714,702 A 2/1998 Ishii ..... 84/462
5,717,818 A 2/1998 Nejime et al. ..... 395/2.2
5,719,944 A 2/1998 Banerjea ..... 381/61
5,726,371 A 3/1998 Shiba et al. ..... 84/603
5,734,119 A 3/1998 France et al. ..... 84/622
5,744,739 A 4/1998 Jenkins ..... 84/603
5,744,742 A 4/1998 Lindemann et al. ..... 84/623
5,745,650 A 4/1998 Otsuka et al. ..... 395/2.69
5,763,800 A 6/1998 Rossum et al. ..... 84/603
5,765,129 A 6/1998 Hyman et al. ..... 704/270
5,774,863 A 6/1998 Okano et al. ..... 704/278
5,781,696 A 7/1998 Oh et al. ..... 395/2.79
5,784,017 A 7/1998 Craven ..... 341/126
5,792,971 A 8/1998 Timis et al. ..... 84/609
5,809,454 A 9/1998 Okada et al. ..... 704/214
5,837,914 A 11/1998 Schwartz et al. ..... 84/622
5,847,303 A 12/1998 Matsumoto ..... 84/610
5,873,059 A 2/1999 Iijima et al. ..... 704/207
5,913,259 A 6/1999 Grubb et al. ..... 84/610
5,917,917 A 6/1999 Jenkins et al. ..... 381/63
5,936,859 A 8/1999 Huang et al. ..... 364/400.01
5,952,596 A * 9/1999 Kondo ..... 84/605
5,952,597 A * 9/1999 Weinstock et al. ..... 84/609
6,107,559 A * 8/2000 Weinstock et al. ..... 84/634
6,166,314 A * 12/2000 Weinstock et al. ..... 84/609

* cited by examiner

| Performance Tick | Part Number | Note Number | Velocity |
|---|---|---|---|
| 120 | 1 | 43 | 64 |
| 150 | 2 | 44 | 100 |
| 160 | 1 | 43 | 0 |
| 200 | 2 | 44 | 0 |
| . | . | . | . |
| . | . | . | . |
| . | . | . | . |
| . | . | . | . |
| . | . | . | . |
| . | . | . | . |
| . | . | . | . |
| . | . | . | . |
| . | . | . | . |
| 8096 | 2 | 50 | 0 |

21 22 23 24

ELECTRONIC SCORE TRACKING MUSICAL INSTRUMENT

RELATED APPLICATION

This disclosure relates to Japanese Application Hei 11 306639, which is incorporated by reference herein and from which priority is claimed.

FIELD OF THE INVENTION

The present invention relates to an electronic musical instrument and, in particular, to an electronic musical instrument that has an accompaniment capability.

BACKGROUND OF THE INVENTION

For some time, electronic musical instruments have included accompaniment capabilities such that, at the time that a performer renders a performance by, for example, operating the keys of a keyboard, an accompaniment is played by the electronic musical instrument with a composition that accompanies the main composition that is being performed by the performer. With this type of electronic musical instrument, it is possible for the performer to enjoy an accompanied performance, accompanied by the composition that has been supplied by the electronic musical instrument. In addition, with prior electronic musical instruments, the performer can adjust the performance tempo of the accompanying composition, for example, by operating such things as a dial used for tempo adjustment. The performer can then perform the main composition while matching the accompanying composition by adjusting the tempo of the accompanying composition.

However, when the performer originally performs the main composition, he or she performs it at a free tempo that is in accord with his or her own feelings. Despite the fact that the accompanying composition should be made to accompany the performance by the performer, that is, matching the performance tempo of the main composition, there has been a problem with prior art electronic musical instruments in that if the performer performs at a free tempo in accord with his or her own feelings at the time of the performance, the tempo of the accompaniment will be off. In addition, there are cases where the performer desires to perform, and change the performance tempo in the middle of the composition. With the prior art electronic musical instruments, in order to match the performance tempo, the tempo of the accompaniment must be adjusted if the performer changes tempo in the middle of a composition. In addition to changing the performance tempo in the middle of the composition, the performer must carry out the performance of the main composition while operating such things as a dial for adjusting the tempo of the accompaniment. Attempting to match the tempo of the accompaniment to the performance can thus prove troublesome.

SUMMARY OF THE DISCLOSURE

Accordingly, to overcome limitations in the prior art described above, and to overcome other limitations that will become apparent upon reading the present specification, preferred embodiments of the present invention relate to an electronic musical instrument with which it is possible to have an accompaniment that tracks the performance tempo of the performer. Preferred embodiments of the present invention relate to methods and apparatus for taking into consideration the difficulties in matching a performance of a musical piece by an artist with an electronically provided accompaniment.

A preferred embodiment of the present system comprises an electronic musical instrument that adjusts the tempo of an accompaniment to track the performance tempo of the performer. In particular, preferred embodiments of the present system provide a method for receiving performance data in which a multiple number of performance data characteristics are received and analyzed in accordance with the progression of a performance of a composition by a musician.

In particular preferred embodiments of the present invention provide a storage means in which a sequence of performance data, which characterizes a specific performance composition is stored.

Preferred embodiments also contain a retrieval means in which, from the sequence of performance data that has been stored within the storage means, segments that correspond to the multiple sequences of performance data, which has been continuously received when the storage means are retrieved.

Preferred embodiments also comprise a tempo calculation means. The tempo calculation means can perform a comparison between the stored performance data segments and the data that is being continually received by the performance data reception means. By means of a comparison between the performance data, with which the segments of data have been found in the previously mentioned retrieval means and the multiple number of performance data that have been continuously received by the aforementioned performance data reception means, the relative performance tempos of the multiple number of performance data that have been continuously received by said performance data reception means are calculated with respect to the performance tempo in the segments and in accompaniment means in which an accompaniment is done at a performance tempo that corresponds to the relative performance tempos that have been calculated by the previously mentioned tempo calculation means. In other words, the tempo calculation means can compare the performance as received with a performance as stored in memory. By knowing the relative performance tempos of the stored performance and the received performance the embodiment can adjust the tempo of the accompaniment.

In an exemplary embodiment, performance data reception means may be one that is primarily composed of the keyboard, wherein the performer performs by operating the keyboard, etc. and receives the performance data that expresses each performance operation at the time of the performance of the operation. In other embodiments, the performance data reception may be one in which the MIDI data, etc. of the composition is provided by such things as a Musical Instrument Digital Interface port, and is received in real time in accordance with the reproduction of the composition.

In accordance with embodiments of electronic musical instrument used with the present invention, the relative performance tempo of the performance and operation by the performer is calculated using the performance tempo of the main composition that has been stored in advance it the storage means as the standard. The accompaniment is done at a performance tempo that is in accord with the relative performance tempo of the main composition. Accordingly, when the tempo of the performance by the performer is fast, the tempo of the accompaniment is also fast. When the tempo of the performance by the performer is slow, the tempo of the accompaniment is also slow. That is to say, the accompaniment is done by tracking the tempo of the performance of the performer.

With electronic musical instruments embodied by the present invention, the above mentioned retrieval means may be one in which a segment that corresponds to a specified amount of performance data that have been received by the performance data reception means from a sequence of performance data that are stored in the storage means is retrieved. The above mentioned retrieval means may also be one in which a segment that corresponds to a multiple number of performance data that had been recently received in a specified time period by the performance data reception means from a sequence of performance data that are stored in the storage means is retrieved.

In somewhat more general terms, the tempo may be calculated depending upon a specific amount of performance which is received, or the tempo may be calculated by observing how much of a performance is received during a specific amount of time.

With the format in which the performance tempo is calculated based on a specific amount of performance data that has been recently received, the responsiveness of the system is good. This is, in general, because the performance data of the accompaniment tracks at the time that the performer carries out the performance.

In addition, there are cases where the number of times that the performance calculation should be carried out per beat changes greatly within a single composition. In such a case, there are times when the performer performs conscious of the tempo of one beat or several beats despite the number of performance calculation operations. Using the format in which a performance tempo is calculated based on the performance data that have recently been received in a specific time, since this kind of performance tempo for one beat (or for several beats) is calculated, it is possible to have an accompaniment at a tempo that is close to the performance tempo of which the performer is conscious.

In addition, in embodiments of musical instruments of the present invention, the aforementioned tempo calculation means may be one that calculates the mean value of the ratio between each interperformance data time interval in the above mentioned segments and each of the multiple number of interperformance data time intervals that have been received continuously by the performance data reception means that correspond to the segments as the relative performance tempo of the number of performance data that have been received continuously by the performance data reception means with respect to the performance tempos in the segments. The aforementioned tempo calculation means may also be one that calculates the ratio between the total performance time in the above mentioned segments and the total performance time of the multiple number of performance data that have been received continuously by the performance data reception means that correspond to the segments as the relative performance tempo of the multiple number of performance data that have been received continuously by the performance data reception means with respect to the performance tempos in the segments.

In other words, embodiments of the present invention within a musical instrument may reference the tempo in the piece of music being performed to the tempo of the stored reference performance in two different ways. The stored reference performance has a tempo which is known. In addition, the relationship between the tempo of the stored reference performance and the stored accompaniment is known. By knowing a ratio between the tempo of the live performance and the stored reference performance, a ratio can be formed. The ratio can then be used to produce the accompaniment in the correct tempo. The first method of calculating the ratio between the tempo of the live performance and the stored reference performance is to calculate the data time interval of a given segment of the performance. For example, the time that it would take to play the first 15 notes in the actual performance can be determined and compared to the time that it takes to perform 15 notes in the stored reference performance. By knowing the time that it takes to perform the same interval of music in the reference and the actual performance, a tempo ratio can be performed. Several tempo ratios can be formed for the ratio between the tempo and the performed piece and the stored reference performance. These tempo ratios may be then averaged to ascertain a mean value representing the difference in the tempos of the performed work and the stored reference work. Since the stored reference work and the performed work are the same pieces of music, the tempo ratios can be used to speed up or slow down the accompaniment. A mean value of the tempo ratios between the performed and the reference piece may be found. The main values may not be limited to simply an arithmetic mean value but may form weighted mean values or geometrical mean values.

A second way to calculate the tempo of a performed piece of music is as follows: once again the tempo in the performed piece of music will be compared with the tempo in a reference piece which is stored within the instrument. As before, the accompaniment is also stored. The accompaniment is referenced to the stored piece. By forming a ratio of the tempo between the performed piece and the stored reference piece, the difference between the tempo of the performed piece and the reference piece can be determined. This ratio of tempos between the performed piece and the stored piece can then be used to speed up or slow down the tempo of the accompaniment.

In the second method that calculates the ratio of the tempo of the performed piece to the stored reference piece, instead of looking at the time interval that a particular piece of musical data takes, the method ascertains how much data is input within a particular time interval.

With the format in which the mean value of the ratio of the interperformance data time intervals is used as performance tempo, the performer uses a performance tempo at the time of carrying out each performance operation that is suitable to the type of composition of which he or she is conscious and to the performance method; and, with the format in which the ratio of the total performance time of the performance data is used as the performance tempo, the performer uses a performance tempo that is suitable to the composition of which he or she is conscious and to the performance method with, for example, only the beginning of a bar.

BRIEF DESCRIPTION OF THE DRAWINGS

Referring now to the drawings which describe and illustrate embodiments and portions of embodiments of the present invention.

DETAILED DESCRIPTION OF PREFERRED EMBODIMENTS

Figures 1, 2:
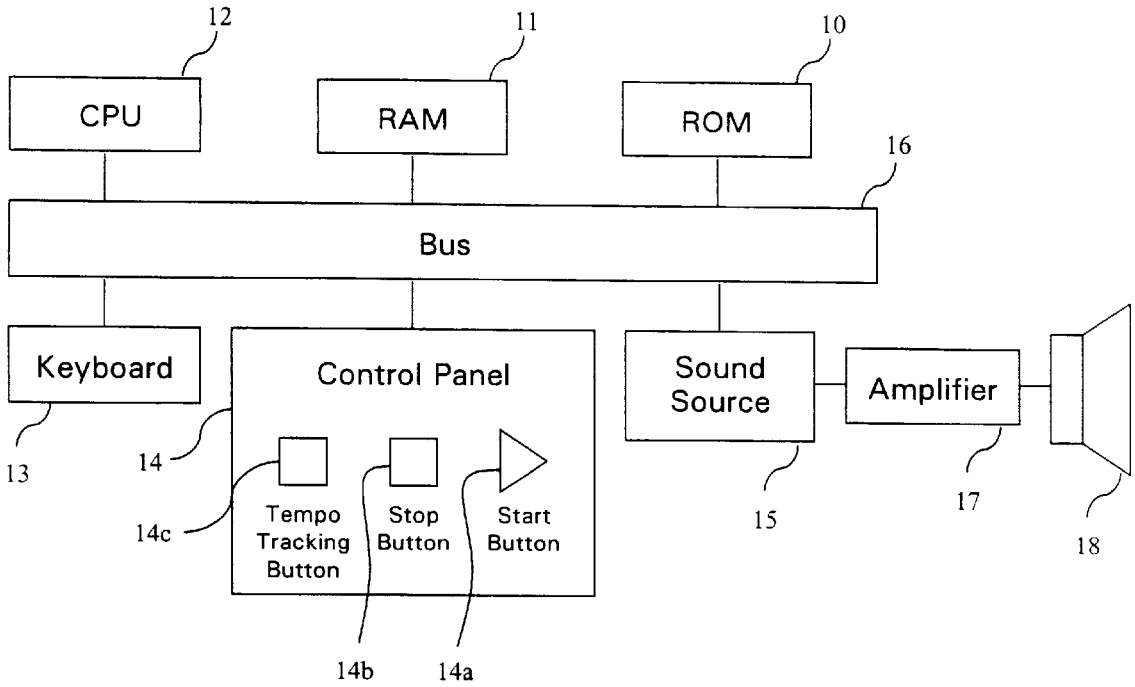
FIG. 1 is a structural diagram of the system of one preferred embodiment illustrating an electronic musical instrument.
FIG. 2 is a graphical diagram that illustrates an example of the performance data that are stored in the ROM.

FIG. 1 is a structural diagram of the system of one preferred embodiment of the present invention within a musical instrument.

In the electronic musical instrument 1, the read only memory (ROM) 10, the random access memory (RAM) 11, the central processing unit (CPU) 12, the keyboard 13, the control panel 14, and the sound source 15 are interconnected via the bus 16. In addition, the amplifier 17 and the speaker 18 are coupled to the sound source 15. The sound source is also coupled to the bus 16.

The ROM 10 is one example of the storage means that can be used in the present invention. In the present illustrated embodiment the ROM 10 stores each of the performance parts including the data that expresses the sequence of notes which make up the composition of the performance. The ROM 10 may also contain the performance data that are made up of such things as note numbers and tempo together with time data. The ROM 10 may also contain other forms of performance data and is not limited to the aforementioned types of performance data. In addition, there are also cases where such things as the performance data are transferred to and stored by RAM 11. Such data can be transferred into RAM 11 from external storage devices such as, for example, floppy disks or memory cards. ROM 10 also stores the program that represents the operation of the CPU 12.

The CPU 12 operates as the calculation means and the accompaniment means that are cited in embodiments of the present invention and operate in accordance with the program that is stored in the ROM 10.

The RAM 11 is used as the working area that is required for the operation of the CPU 12.

The keyboard 13 is an example of a performance data reception means. At the time that the performance is carried out in the form of key presses by the performer. When the keys are pressed by the performer, the key pressing data, which is one example of the performance data that are cited in the present invention, which are configured with a form that is virtually the same as the form of the performance data discussed above, are generated and received. In order words, the performance data as generated by the performer pressing keys can be nearly identical to the performance data of the reference performance stored within the ROM 10. The control panel 14 is equipped with a start button 14A, a stop button 14B, and the tempo tracking button 14C. The electronic musical instrument 1 is also equipped with a designation operator with which the performer designates the main part that is performed by the keyboard 13 from the performance data a multiple number of parts that are stored in the ROM 10. The designation operator is not shown.

When the start button 14A is pressed an automatic performance in accordance with the performance of data of the accompaniment parts other than parts that have been designated with the designation operator from the performance data of the multiple number of parts that are stored in the ROM 10 is started; and when the stop button 14B is pressed the automatic performance is stopped. In addition, at the time the tracking button 14C is pressed, the determination is made whether or not to carry out the tracking operation in which the performance tempo of the automatic performance of the accompaniment part is made to track the performance tempo of the main part by the performer.

FIG. 2 is a diagram showing an example of the performance data that are stored in ROM. The performance data comprise the performance time 21 that is expressed relatively by the unit in "Tick" with the beginning of the composition as the standard, the part number 22, the note number 23, and the velocity 24. One horizontal row in the FIG. 2 represents one piece of performance data that expresses one key press operation or key release operation. With regard to the "Tick," it is a time unit in which one beat has been divided into equal parts. For example, if the tempo is 120 one beat is 500 milliseconds; and, when this is divided into 100 equal parts, one Tick is 5 milliseconds. Here the performance data when the value of the velocity 24 is "0" are note-OFF data (key releasing) and the performance data among the performance data that are shown in FIG. 2 excluding the note-OFF data are note-ON data (key pressing). In FIG. 2, in order to simplify the explanation, only the note-ON data and the note-OFF data are shown. However, in actuality, other control data such as the control change are also stored. A tracking operation is carried out based on the note-ON data and the key pressing data that are output by the keyboard 13.

Figure 3:
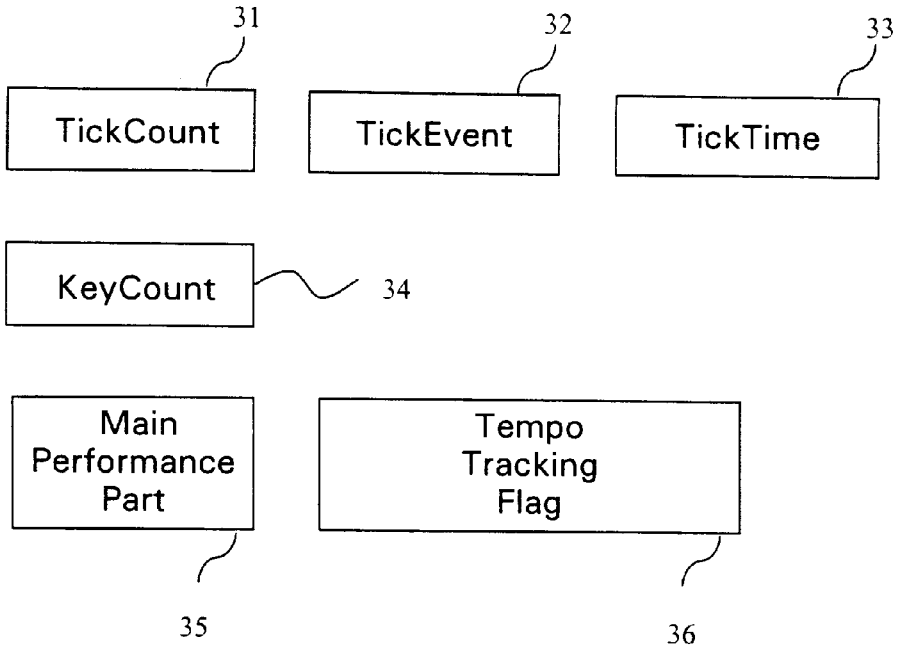
FIG. 3 is a graphical illustration of items such as parameters and flags that are stored in the RAM.

FIG. 3 is a graphical illustration that shows such things as the parameters and things that are stored in RAM. The Tick count 31 is a counter that is incremented by the Tick timer at the time of an automatic performance, and the current time is expressed by the Tick unit. The Tick event 32 is a parameter that indicates the initial performance time of the performance data following the current point in time.

The Tick time 33 is a parameter that expresses the interrupt period of the Tick timer.

The key count 34 is a counter that expresses the amount of expected key pressing data before carrying out the tracking operation and is decremented at the time the performer presses the keys until the value reaches (0).

The main performance part 35 is a parameter that indicates the number of the part that has been designated as the main performance part.

The tempo tracking flag 36 is a flag that indicates whether or not the tracking operation is being performed. The tempo tracking flag 36 toggles whenever the tempo tracking button which is mounted on control panel 14, is pressed. Other than the parameters and flags described and illustrated with reference to FIG. 3, the key pressing queues that store the key pressing operations of the performer are provided in the RAM.

Figure 4:
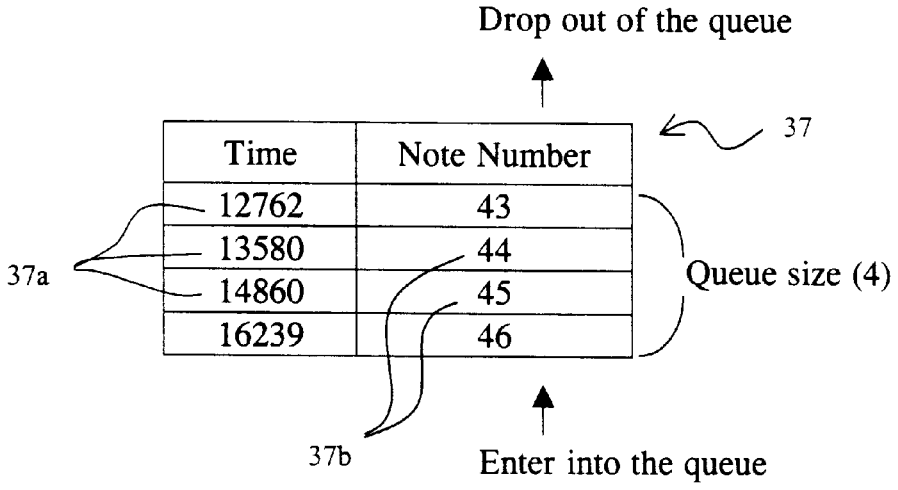
FIG. 4 is a graphical diagram that illustrates key pressing queues that are provided in the RAM.

FIG. 4 is a tabular diagram illustrating the key pressing queues that are provided in the RAM. In FIG. 4 the key pressing queue 37 is shown storing four key pressing operations. In the key pressing queue 37 the operation time 37*a* that has been carried out by the key pressing operation and the note number 37*b* that expresses the pitch that corresponds to the key that has been pressed are stored in the order of the key pressing operations as data that express the key pressing operation. In addition, when the key pressing queue 37 is in a full state and a further key pressing operation is carried out, the data of the topmost level for which the operation time 37*a* is the oldest is dropped out of the queue, the remaining data are repetitively raised one level each and the data that expresses the most recent key pressing operation are inserted at the lowest level of the queue.

The operation of the CPU 12 illustrated in FIG. 1 will be illustrated with respect to the following flow charts. First the performer selects the desired composition from among the multiple number of compositions that are stored and then selects which of the parts of the composition are to be performed.

Figure 5:
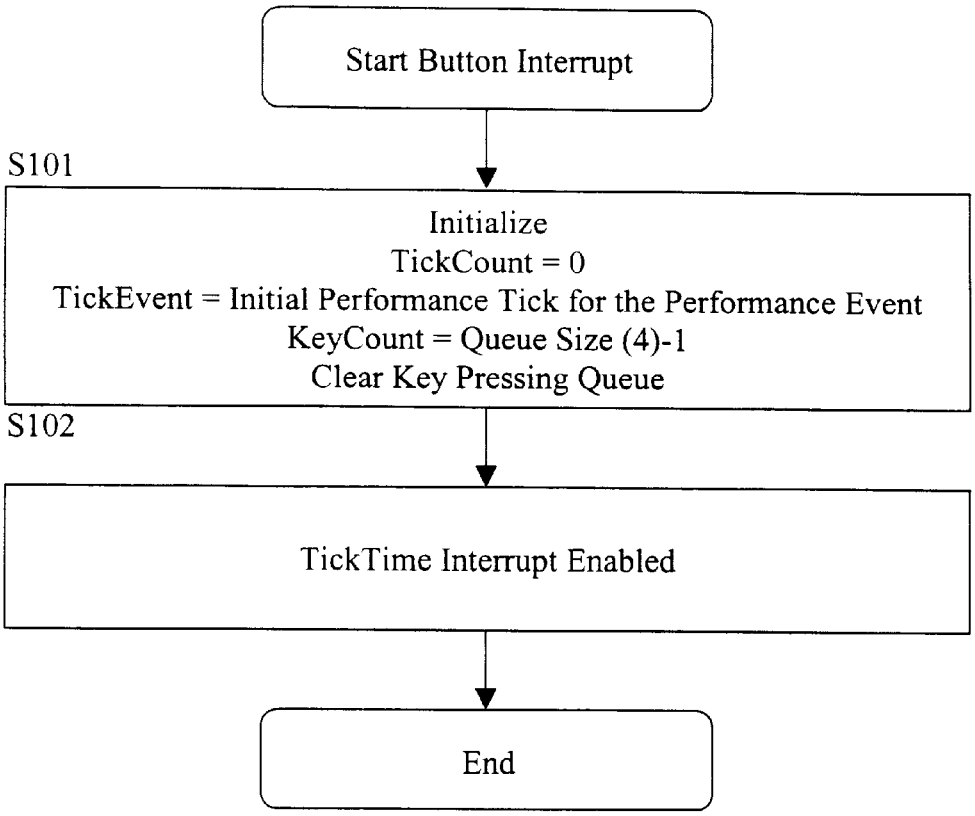
FIG. 5 is a flow chart of a start button interrupt routine.

FIG. 5 is a flow chart of the start button interrupt routine.

The start button interrupt routine is executed when the start button 14A of the control panel 14 is pressed. In Step S101 the initialization of the system is carried out. The Tick count 31, which is shown in FIG. 3, is assigned the value of 0. The performance time is set to the beginning of the composition. The initial performance time for the performance data of the composition is assigned to the Tick event variable 32 which is shown in FIG. 3. One is subtracted from the size of the key pressing queue 37 that is shown in FIG. 4. In FIG. 4 the size of the key pressing queue 37 is equal to 4. This value is assigned to the key count 34 and the key pressing queue 37 is cleared. Following the initialization, the interrupt is enabled by the Tick timer in Step S102, and the routine then ends.

Figure 6:
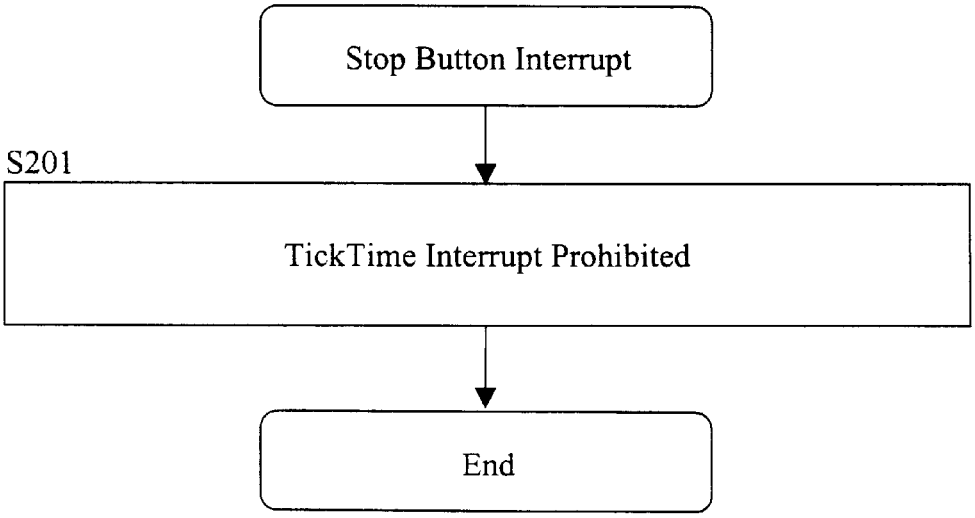
FIG. 6 is a flow chart of a stop button interrupt routine.

FIG. 6 is a flow chart of a stop button interrupt routine. FIG. 6 is a flow chart of a stop button interrupt routine.

The stop button interrupt routine is executed when the stop button 14A of the control panel 14, shown in FIG. 1, is pressed down. The interrupt of the Tick timer is prohibited in step S201 and the routine ends.

Figure 7:
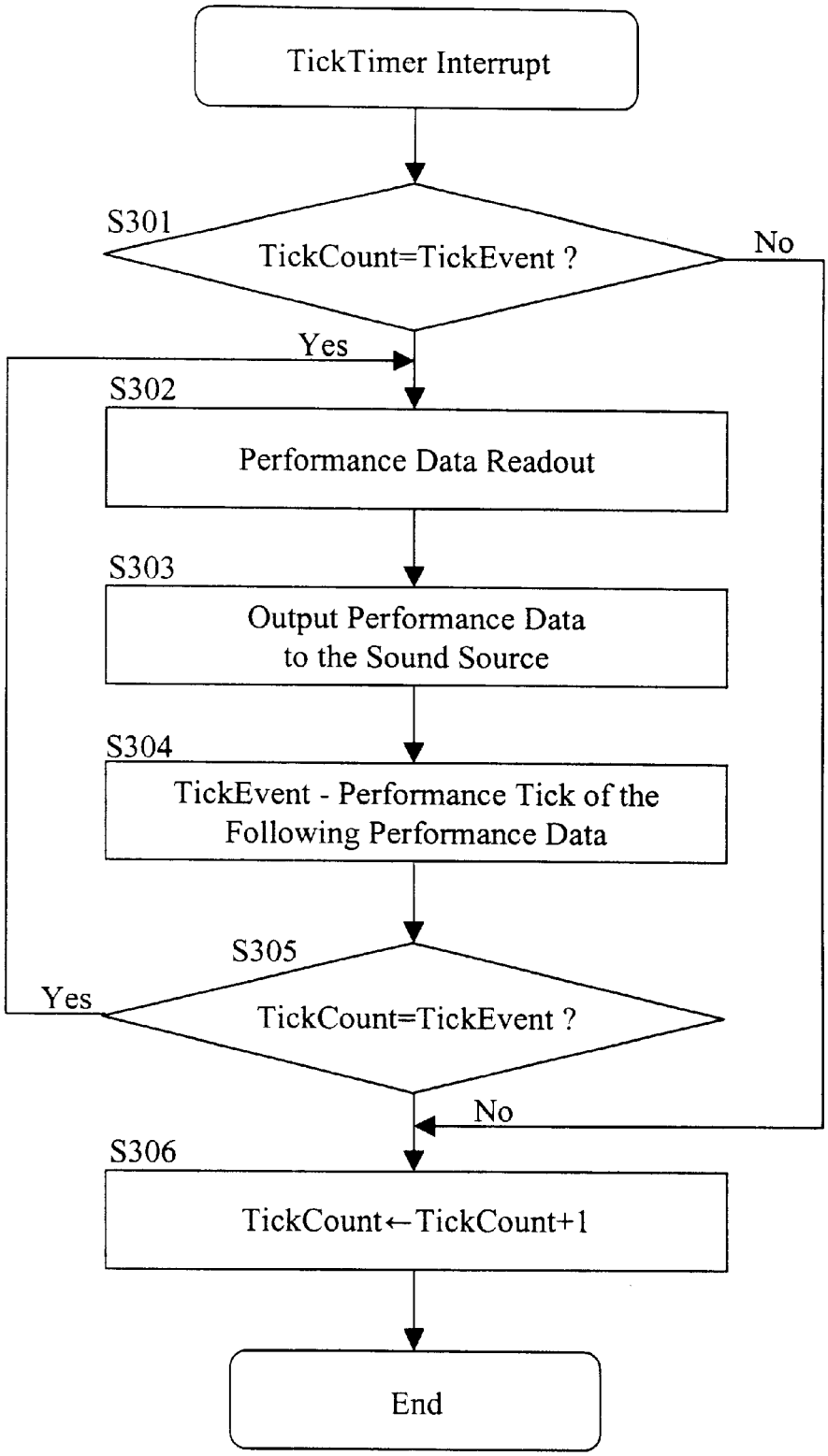
FIG. 7 is a flow chart of a Tick timer interrupt routine.

FIG. 7 is a flow chart of the Tick timer interrupt routine.

When Step S102 of the start button interrupt routine shown in FIG. 5 is executed and the interrupt by the Tick timer has been enabled, the Tick timer interrupt routine is executed for each period indicated by the Tick timer 33. The automatic performance of the accompaniment part is also carried out by the Tick timer interrupt routine. That is to say, the Tick timer interrupt routine corresponds to the accompaniment means and the period indicated by the Tick timer 33 corresponds to the "relative performance tempo."

When the Tick timer interrupt routine is started Tick count 31 and the value of Tick event 32 are compared as illustrated in Step S301. If Tick count does not equal Tick event, indicating that the current time has not yet reached the performance time of the following performance data, the value of Tick count 32 is incremented in Step S306 and the routine then ends.

If, however, tick count does equal the tick event, the performance time of the following performance data has been reached, the performance data are read out of the ROM 10 that is shown in FIG. 1 in Step 302, the performance data that had been read out are then output to the sound source 15, the generation of the performance sound or termination is carried out (in Step S303) and the performance time of the following performance data is again assigned to tick even 32 (Step S304).

Since there are cases where the ROM 10 contains a multiple number of performance data that mutually have identical performance times, the value of the tick count 31 and the value of the tick event 32 are compared once more in Step S305. If it is determined that these values are the same, Step S302 through S305 are repeated. Then in the case where there is no performance data that should be sent to the sound source by the current time that is indicated by the value of the tick count 31, that is tick count does not equal to tick event, the value of tick count is incremented in Step S306 and the routine ends.

Figure 8:
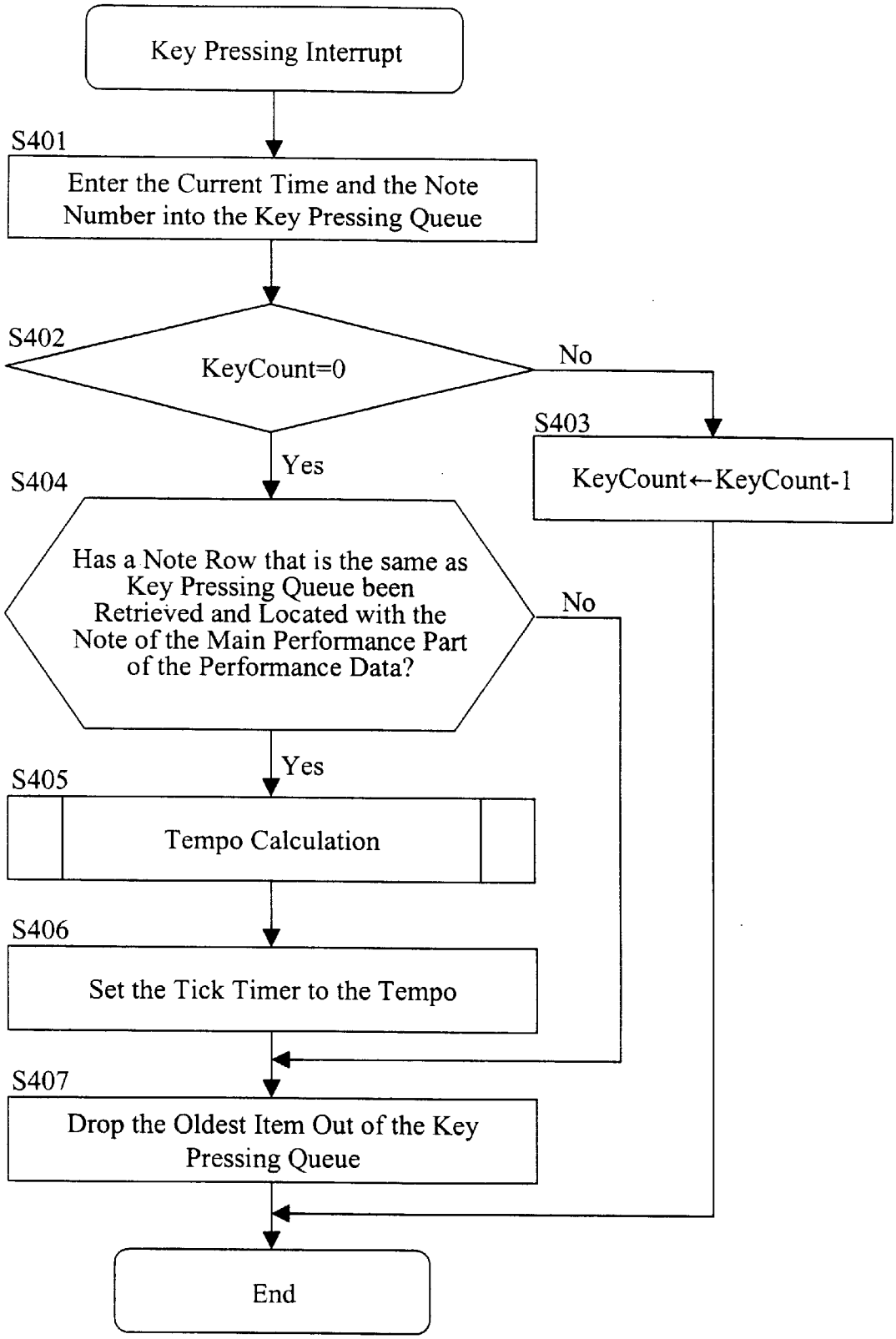
FIG. 8 is a flow chart of a key pressing interrupt routine.

FIG. 8 is a flow chart of the key pressing cut in routine.

The key pressing cut in routine is one example of the retrieval means and the tempo calculation means. When the tempo tracking flag, shown in FIG. 3, indicates that it is the time of the tracking operation, it is executed when the tempo tracking flag 36 is set, it indicates that the tracking operation is active. The key pressing cut in routine executes at the time that the performer presses the keys of keyboard 13.

When the key pressing cut in routine is started, the current time and note number that corresponds to the key that is currently being pressed are inserted into the key pressing queue 37 as shown in FIG. 4 (Step S401). Then, if the value of the variable key count 31 is not zero, in other words when there is a vacancy in the key pressing queue 37 (Step S402: no) the key count 31 is then decremented (Step S403) and the routine ends.

On the other hand, in the case where the value of the key count 31 is equal to zero, in other words when the key queue 37 is full (Step S402: yes), from among the performance data for the main performance part in the performance data that are stored in the ROM 10 that is shown in FIG. 1, the note number row that is the same as the note number row 37B which is stored in the key pressing queue is retrieved (Step S404). Then, when the same note number row has been located (Step S404: yes), as will be further explained, the performance tempo is calculated (Step S405).

One example of the case where the same note number row has been located by the retrieval in the above mentioned Step S404 is shown in Table 1 and 2.

TABLE 1

| Time | Note Number |
|---|---|
| KT1 | 43 |
| KT2 | 44 |
| KT3 | 45 |
| KT4 | 46 |

TABLE 2

| Performance Tick | Part | Note Number | Velocity |
|---|---|---|---|
| PT1 | 2 | 43 | 64 |
| PT2 | 2 | 44 | 100 |
| PT3 | 2 | 45 | 90 |
| PT4 | 2 | 46 | 80 |

Table 1 is a table illustrating an example of the data that are stored in the key pressing queue and, here, the note number rows "43, 44, 45 and 46" are stored. In addition, the operation times that each key has been pressed down "KT1, KT2, KT3 and KT4" which correspond to these note numbers are stored.

Table 2 shows the condition when the note number rows "43, 44, 45 and 46" have been located and, here, the main performance part is the number "2 part." In addition, the performance time for each note of the performance data is shown in "PT1, PT2, PT3 and PT4." When the note number row is located in this manner, based on the operation times "KT1, KT2, KT3 and KT4" and the performance times "PT1, PT2, PT3 and PT4," the performance tempo, in other words, the tick time is calculated in an equation as shown in equation 1 (EQN 1) below.

$$\text{Tick Time}=[(KT1-KT2)/(PT1-PT2)+(KT2-KT3)/(PT2-PT3)+(KT3-KT4)/(PT3-PT4)]/3 \quad \text{EQN 1}$$

EQN 1 expresses a format in which the mean value of the ratio between the time intervals between the key pressing operations by the performer and the time intervals between the performance times of the performance data that are stored is used as the performance tempo. The ratio "(KT1–KT2)/(PT1–PT2)", "the ratio (KT2–KT3)/(PT2–PT3)", etc. are determined by the timing of each separate key pressing operation by the performer. Because of this, with the format in which the performance tempo, in other words, the tick time, is calculated by EQN 1, the performer uses a performance tempo at the time of carrying out each performance operation that is suitable to the type of composition of which he or she is conscious and to the performance method.

In addition, an equation such as EQN 2 may be substituted for EQN 1 in the calculation of performance tempo. In other words, the calculation of tick time.

$$\text{Tick Time}=(KT1-KT4)/(PT1-PT4) \quad \text{EQN 2}$$

EQN 2 uses a format in which the ratio of the total operating key time for the key press by the performer and the total performance time of the performance data that are stored is used as the performance tempo. Using the format of the EQN 2, such operating times such as "KT2+KT3 are ignored." Because of this, the performer uses the performance tempo that is suitable to the composition of which he or she is conscious and to the performance method with, for example, only the beginning of a bar.

When the tick time is calculated according to EQN 2 and the performance tempo is calculated by Step S405 of FIG. 8, the tick time cut in adjustment is set by assigning the calculation results of EQN 2 to the tick time 33 that is shown in FIG. 3 (Step S406). As a result, the accompaniment part is automatically performed at the same performance tempo as the main performance part being performed by the performer. In the next step (Step S407) the data of the upper most level, which is the oldest operating time 37*a* from among the data that is stored in the key pressing queue 37, is dropped from the queue. The routine then ends.

From Step S404 where the note in the performance cannot be matched to the stored reference, performance calculation of the performance tempo cannot be carried out. And Step S407 is then executed next. In Step 407, the oldest data that is stored in the key pressing queue 37 is dropped out of the queue and then the routine is end.

In the preferred embodiment just described, the performance tempo is calculated based on a specified number of recent key presses by the performer (4 in the exemplary embodiment). Because the performance tempo of the accompaniment tracks while the performer presses the keys, the responsiveness of the system is good.

In a further embodiment, which illustrates the different method of calculation of performance tempo, the performance tempo is calculated based on recent key presses over a specified period of time. In this type of further embodiment, it is possible for the accompaniment to be played at a tempo close to the performer's tempo even where the tempo varies greatly within a single performance.

There are then two different methods of determining the tempo of a performance. In the first method, the time between beats or number of beats is determined. In the preferred embodiment previously described, the tempo was determined based on the four most recent notes (i.e., beats). The other method of determining the tempo of a piece is to measure the number of beats in a given time.

These methods differ in the tick timer cut in routine and key pressing routine and in the fact that the queue size of the key press queue is larger in the instance where the time between beats is measured. The following explanations will emphasize the differences between the two methods of tempo determination.

Figure 9:
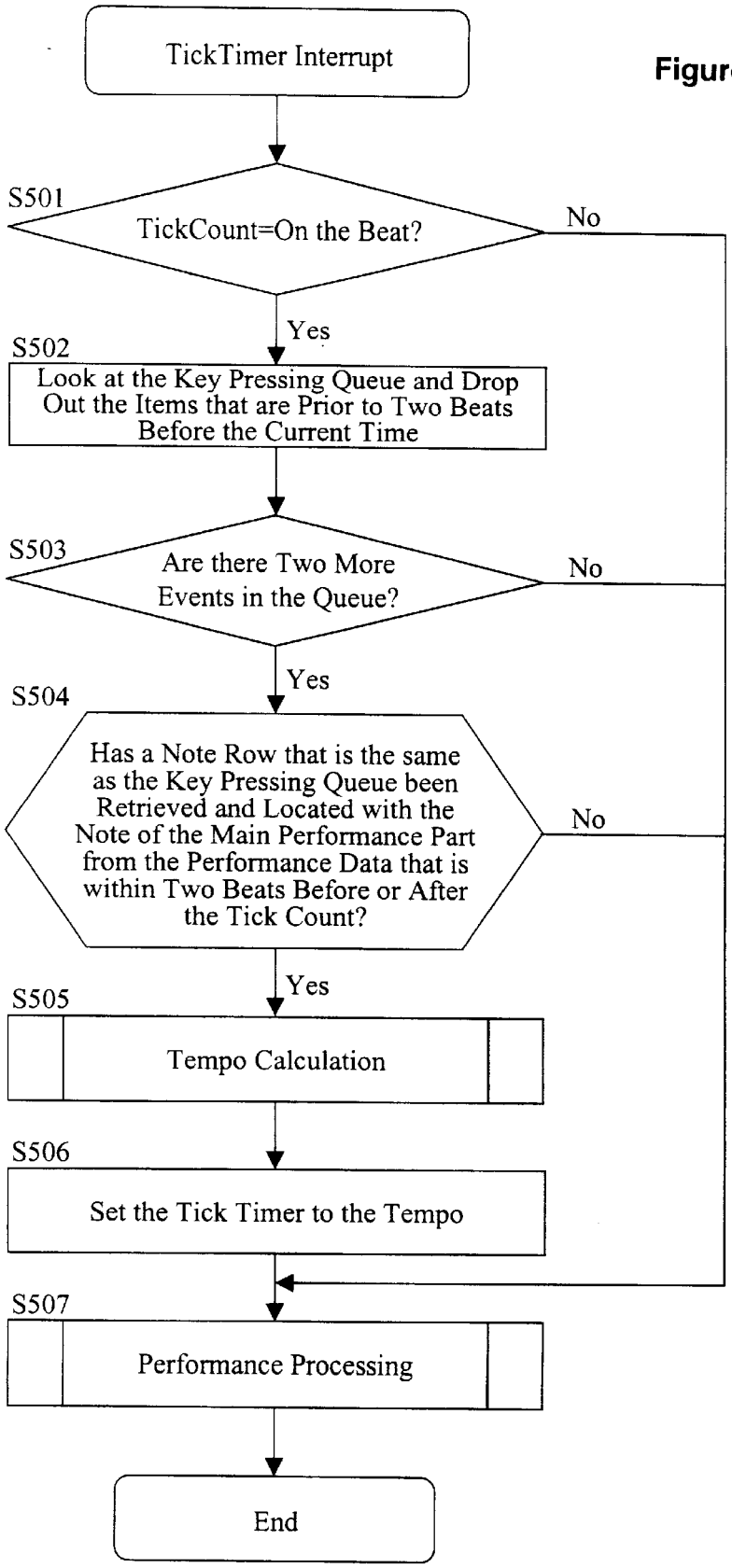
FIG. 9 is a flow chart of the Tick timer interrupt routine of another preferred embodiment of the invention.

FIG. 9 is a flow chart of the tick timer cut in routine of the preferred embodiment in which the number of beats in a particular time is measured.

The tick timer is enabled in Step S102 in which the start button cut in routine (shown in FIG. 5) is executed. The tick timer cut in routine is executed for each period indicated by the tick time 33 (as shown in FIG. 3) and serves as the retrieval means, the tempo calculation means, and the accompaniment means. When the tick timer cut in routine is started, first the determination is made as to whether the current time that is expressed by the value of the tick count 31 (shown in FIG. 3) is a time that corresponds to one on the beat (Step S501). If it is determined that the time corresponds to the beat time, the data stored in the key pressing queue, which is older than two beats prior to the current beat are dropped out of the queue (Step S502). If there are two or more pieces of data (events) that remain in the key pressing queue (S503 yes), the note number row that is the same as the note number row stored in the key pressing queue is retrieved from the performance data (Step S504). Then in the case where the note number row that is the same has been located (Step S504 yes) EQN 1 or EQN 2 is used to calculate the performance tempo (Step S505). The performance tempo that has been calculated is assigned to the tick time 33 (as shown in FIG. 3). In this way, the cut in period for the tick timer is set (S506). In the next step (Step S507), the performance processing with which the accompaniment is performed is executed and the routine then ends. The accompaniment is thereby adjusted to the performer's tempo.

In the case where it is determined that the current time is shifted from the time that corresponds to that on the beat (Step S501: no), in the case where no more than one note number row that is the same has not been located (Step S504: no), routine advances to Step S507 as it is without calculating the performance tempo, the performance processing is executed and the routine ends.

Figure 10:
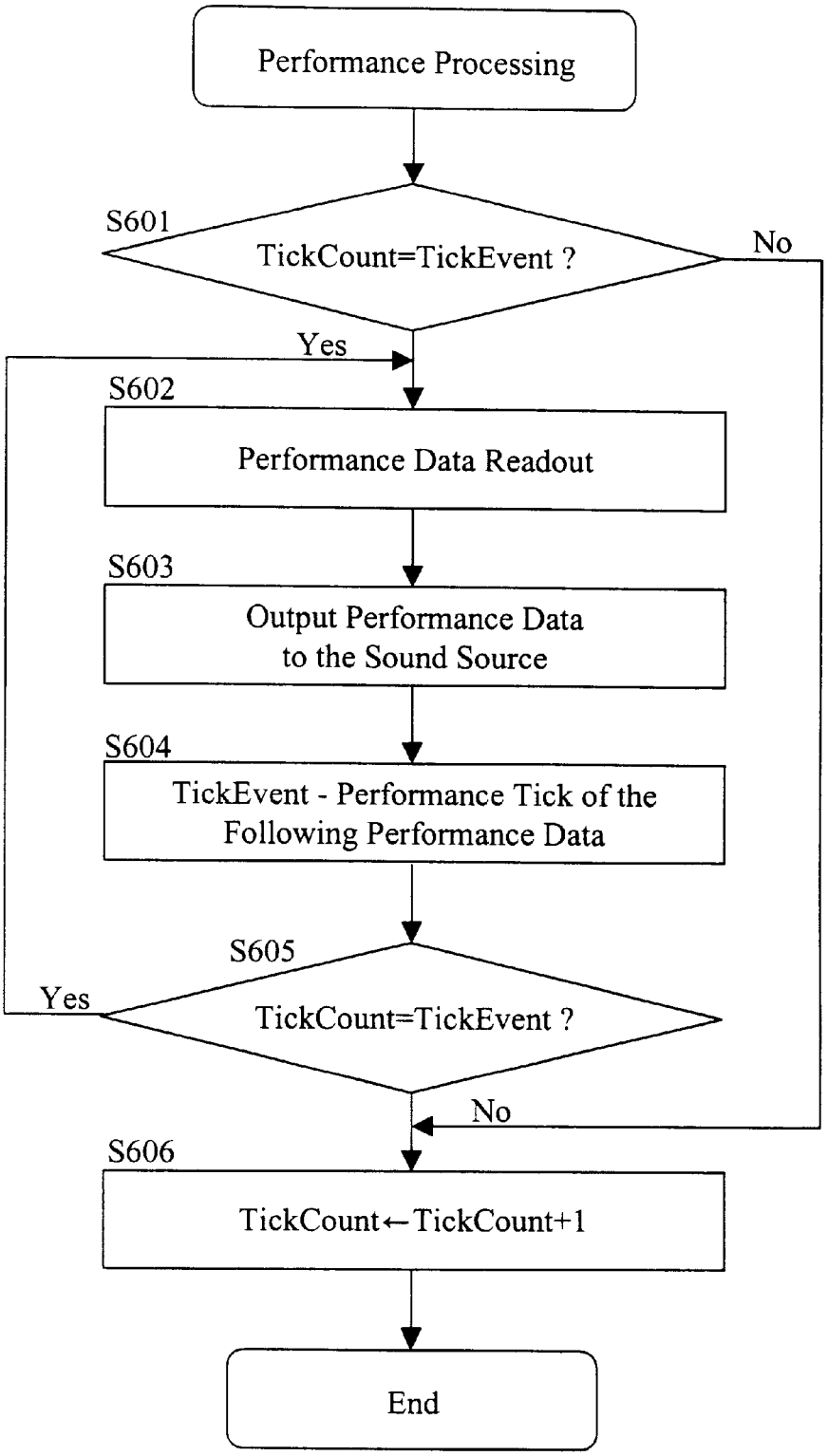
FIG. 10 is a flow chart of the performance processing in an embodiment of the invention.

FIG. 10 is a flow chart of the performance processing. Since the flow chart is exactly the same as the flow chart of the tick timer interrupt routine that is shown in FIG. 7 the explanation is omitted.

Figure 11:
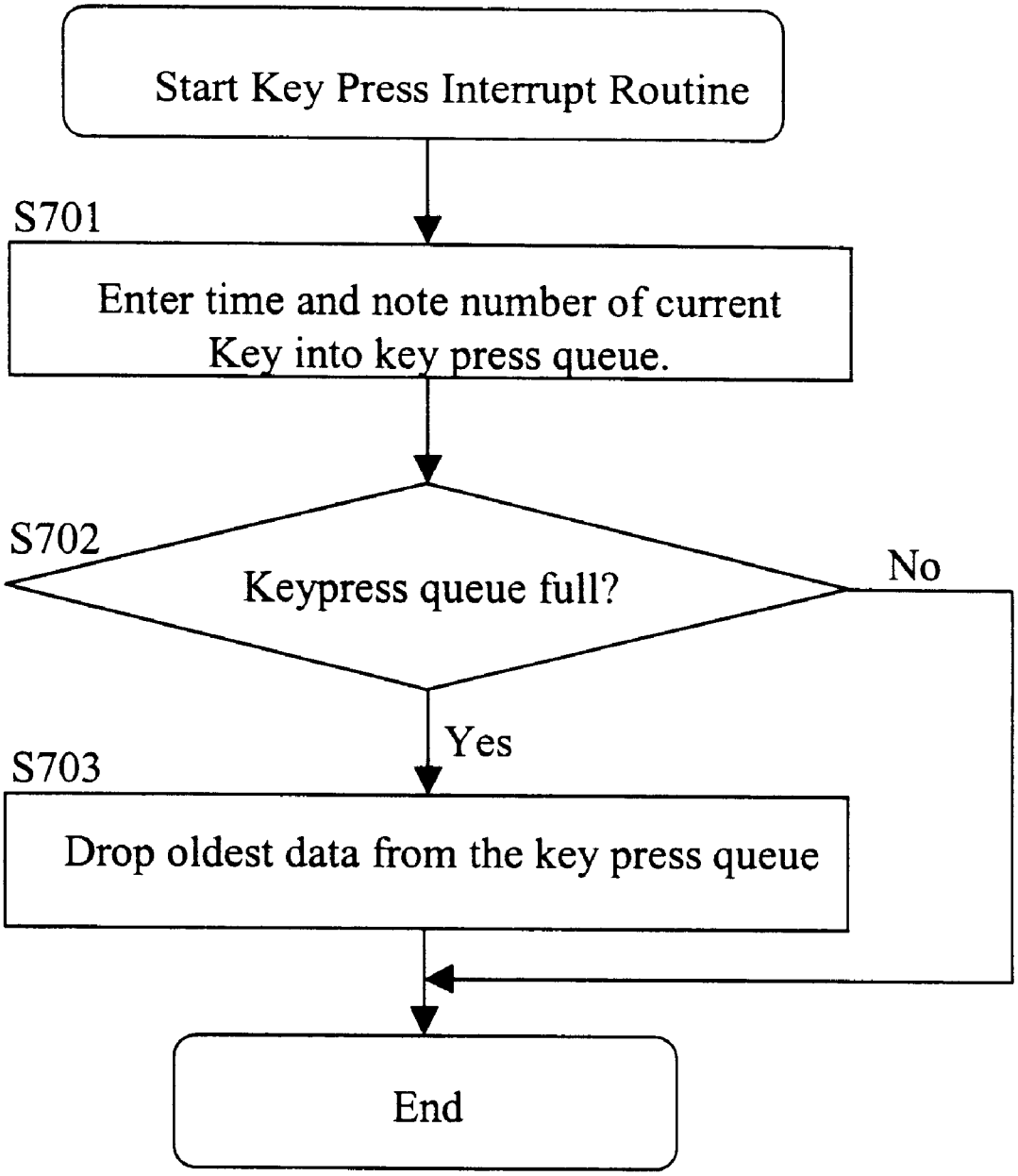
FIG. 11 is a flow chart of key pressing interrupt routines of a preferred embodiment of the invention.

FIG. 11 is a flow chart of key pressing interrupt routine of the other preferred embodiment. If the tempo tracking flag (shown in FIG. 3) indicates that tracking is operating the key press interrupt routine is executed when the performer presses a key. When the key pressing routine is first started the current time and note number that corresponds to the key that is currently being pressed are entered in the queue. (Step S701). Then, if the key press queue is full the oldest data in the key press queue is dropped and the routine ends. If Step S702 determines that the key press queue is not full (Step S702: no), the routine ends.

In the foregoing preferred embodiments, a note number row that is the same as a note number row that is stored in the key press routine is retrieved from the performance data that is stored in ROM. However, the retrieval means in the present invention may also retrieve the next row of data at the same time.

Both the retrieval and the calculation of performance tempo are executed based on all of the note number rows that are stored in the key press queue. However, in embodiments of the present invention, a segment that corresponds to a portion of a note number row that is stored in the key pressing queue may be located based on the entire note number row that is stored in the key pressing queue and the performance tempo may also be calculated based on a portion of a note number row.

In the aforementioned preferred embodiments, the accompaniment part accompanies a composition. However, the accompaniment means may also be one in which the sound of a percussion instrument or a phrase that is repeated is produced in conformance with the performance tempo that has been calculated.

What is claimed is:

1. A method of synchronizing a musical accompaniment to a performance, the method comprising:

providing stored performance data representing a musical composition having a known tempo;

providing accompaniment data for an accompaniment for the musical composition represented by the performance data, said accompaniment having a known tempo;

receiving performance data, which is an audible recital of at least a portion of the same musical composition represented by the stored performance data;

calculating a ratio of the tempo of the received performance to the tempo of the stored performance;

performing the accompaniment data; and using said calculated ratio to adjust performance of the accompaniment data thereby adjusting the tempo of the accompaniment.

2. A method as in claim 1 wherein the calculating a ratio between the tempo of the received performance and the tempo of the stored performance further comprises:

determining a first time period required for a performance of a given segment of the performance data;

determining a second time period required for a recital of the same given segment of the received performance data; and dividing the second time period by the first time period to compute said ratio.

3. A method as in claim 1 wherein the calculating a ratio of the tempo of the received performance to the tempo of the stored performance further comprises:

determining a first amount of the received data recited for said given time;

determining a second amount of the performance data performed for a given time; and dividing the first amount by the second amount.

4. A method of synchronizing a musical accompaniment to a performance, the method comprising:

providing stored performance data representing a musical composition having a known tempo;

providing accompaniment data for an accompaniment for the musical composition represented by the performance data, said accompaniment having a known tempo;

receiving performance data, which is a recital of at least a portion of the same musical composition represented by the stored performance data;

calculating a ratio of the tempo of the received performance to the tempo of the stored performance;

performing the accompaniment data;

using said calculated ratio to adjust performance of the accompaniment data thereby adjusting the tempo of the accompaniment;

wherein the calculating a ratio between the tempo of the received performance data to the tempo of the stored performance data further comprises:

calculating a plurality of ratios between the tempo of the stored performance data and the tempo of the received performance data; and setting the ratio to a mean value of the plurality of ratios.

5. A method as in claim 4 wherein the mean comprises a weighted mean.

6. A method of synchronizing a musical accompaniment to a performance, the method comprising:

providing stored performance data representing a musical composition having a known tempo;

providing accompaniment data for an accompaniment for the musical composition represented by the performance data, said accompaniment having a known tempo;

receiving performance data, which is a recital of at least a portion of the same musical composition represented by the stored performance data;

calculating a ratio of the tempo of the received performance to the tempo of the stored performance;

performing the accompaniment data;

using said calculated ratio to adjust performance of the accompaniment data thereby adjusting the tempo of the accompaniment;

wherein the calculating a ratio between the tempo of the received performance data to the tempo of the stored performance data further comprises:

determining a first amount of the received data recited for said given time;

determining a second amount of the performance data performed for a given time; and dividing the first amount by the second amount; and wherein the determining a first time period required for a performance of a given segment of the performance data comprises determining a first time period required for a performance of a bar of music.

7. A method of synchronizing a musical accompaniment to a performance, the method comprising:

providing stored performance data representing a musical composition having a known tempo;

providing accompaniment data for an accompaniment for the musical composition represented by the performance data, said accompaniment having a known tempo;

receiving performance data, which is a recital of at least a portion of the same musical composition represented by the stored performance data;

calculating a ratio of the tempo of the received performance to the tempo of the stored performance;

performing the accompaniment data;

using said calculated ratio to adjust performance of the accompaniment data thereby adjusting the tempo of the accompaniment;

wherein the calculating a ratio between the tempo of the received performance and the tempo of the stored performance further comprises:

determining a first time period required for a performance of a given segment of the performance data;

determining a second time period required for a recital of the same given segment of the received performance data;

dividing the second time period by the first time period to compute said ratio; and wherein determining a first time period required for a performance of a given segment of the performance data further comprises determining a time period required for the performance of four successive notes.

8. A method of synchronizing a musical accompaniment to a performance, the method comprising:

providing stored performance data representing a musical composition having a known tempo;

providing accompaniment data for an accompaniment for the musical composition represented by the performance data, said accompaniment having a known tempo;

receiving performance data, which is a recital of at least a portion of the same musical composition represented by the stored performance data;

calculating a ratio of the tempo of the received performance to the tempo of the stored performance;

performing the accompaniment data;

using said calculated ratio to adjust performance of the accompaniment data thereby adjusting the tempo of the accompaniment;

wherein the calculating a ratio between the tempo of the received performance and the tempo of the stored performance further comprises:

determining a first time period required for a performance of a given segment of the performance data;

determining a second time period required for a recital of the same given segment of the received performance data;

dividing the second time period by the first time period to compute said ratio; and wherein determining a second time period required for a recital of said given segment of the received performance further comprises determining a time required to receive the data of four successive notes.

9. A method as in claim 8 wherein data of four successive notes comprise the data from four most recent notes of received performance data.

10. A method of synchronizing a musical accompaniment to a performance, the method comprising:

providing stored performance data representing a musical composition having a known tempo;

providing accompaniment data for an accompaniment for the musical composition represented by the performance data, said accompaniment having a known tempo;

receiving performance data, which is a recital of at least a portion of the same musical composition represented by the stored performance data;

calculating a ratio of the tempo of the received performance to the tempo of the stored performance;

performing the accompaniment data; and using said calculated ratio to adjust performance of the accompaniment data thereby adjusting the tempo of the accompaniment;

wherein calculating a ratio of tempo of the stored performance and tempo of the received performance further comprises:

providing a first PT1, second PT2, third PT3 and fourth PT4 stored performance data representing performance times of successive notes of the stored performance data;

matching the first PT1, second PT2, third PT3 and fourth PT4 stored performance data to equivalent first KT1, second KT2, third KT3 and fourth KT4 times of corresponding received performance data;

setting the tempo ratio of received performance to tempo of stored performance=[(KT1–KT2)/(PT1–PT2)+(KT2–KT3)/(PT2–PT3)+(KT3–KT4)/(PT3–PT4)]/3.

11. A method of synchronizing a musical accompaniment to a performance, the method comprising:

providing stored performance data representing a musical composition having a known tempo;

providing accompaniment data for an accompaniment for the musical composition represented by the performance data, said accompaniment having a known tempo;

receiving performance data, which is a recital of at least a portion of the same musical composition represented by the stored performance data;

calculating a ratio of the tempo of the received performance to the tempo of the stored performance;

performing the accompaniment data; and using said calculated ratio to adjust performance of the accompaniment data thereby adjusting the tempo of the accompaniment;

wherein calculating a ratio between the tempo of the stored performance and the tempo of the received performance further comprises:

providing a first PT1, second PT2, third PT3 and fourth PT4 stored performance data representing performance times of successive notes of the stored performance data;

matching the first PT1, second PT2, third PT3 and fourth PT4 stored performance data to equivalent first KT1, second KT2, third KT3 and fourth KT4 received performance data;

setting the ratio of the tempo of the received performance data to the tempo of the stored performance=(KT1–KT4)/(PT1–PT4).

12. A method of synchronizing a musical accompaniment to a performance, the method comprising:

providing stored performance data representing a musical composition having a known tempo;

providing accompaniment data for an accompaniment for the musical composition represented by the performance data, said accompaniment having a known tempo;

receiving performance data, which is a recital of at least a portion of the same musical composition represented by the stored performance data;

calculating a ratio of the tempo of the received performance to the tempo of the stored performance;

performing the accompaniment data;

using said calculated ratio to adjust performance of the accompaniment data thereby adjusting the tempo of the accompaniment;

wherein calculating a ratio between the tempo of the stored performance and the tempo of the received performance further comprises:

selecting a time interval;

determining the amount of stored performance data (Pd) that corresponds to the time interval;

determining the amount of received performance data (Rd) that is recited in the same interval; and setting the ratio of the tempo of the received performance data to the tempo of the stored performance equal to Rd/Pd.

13. An apparatus for synchronizing a musical accompaniment to a performance comprising:

data storage for storing performance data;

data storage for storing accompaniment data;

an input for receiving audible performance data; and a computing circuit for calculating a ratio of the tempo of the received audible performance to the tempo of the stored performance, wherein the computing circuit comprises a circuit for adjusting the tempo of the accompaniment using the ratio calculated by the computing circuit.

14. An apparatus as in claim 13 wherein the computing circuit for calculating a ratio between the tempo of the received audible performance data and the tempo of the stored performance data further comprises:

a computing element; and a program comprising the steps of:

determining a first time period required for a recital of a given segment of the received audible performance data;

determining a second time period required for a performance of said given segment of the performance data; and dividing the first time period by the second time period.

15. An apparatus as in claim 13 wherein the computing circuit for calculating a ratio of the tempo of the received audible performance data to the tempo of the stored performance data comprises:

a computing element; and a program comprising the steps of:

determining a first amount of received data recited for a given time;

determining a second amount of performance data performed for said given time;

dividing the first amount by the second amount to obtain a ratio; and adjusting the tempo of the accompaniment in proportion to the ratio.

16. An apparatus as in claim 13 wherein the data storage for storing performance data is Random Access Memory (RAM), Read Only Memory (ROM), floppy disk or memory card.

17. An apparatus as in claim 13 wherein the data storage for storing accompaniment data is Random Access Memory (RAM), Read Only Memory (ROM), floppy disk or memory card.

18. An apparatus as in claim 13 wherein the input for receiving performance data is an electronic keyboard or Musical Instrument Digital Interface (MIDI).

19. An apparatus for synchronizing a musical accompaniment to a performance comprising:

data storage for storing performance data;

data storage for storing accompaniment data;

an input for receiving performance data;

a computing circuit for calculating a ratio of the tempo of the received performance to the tempo of the stored performance and for adjusting the tempo of the accompaniment;

wherein the computing circuit for calculating a ratio between the tempo of the received performance data to the tempo of the stored performance data comprises:

a computing element; and a program comprising the steps of:

calculating a plurality of ratios of tempos of stored performance segments to tempos of the received performance segments; and taking the mean value of said plurality of ratios.

20. An apparatus for synchronizing a musical accompaniment to a performance comprising:

data storage for storing performance data;

data storage for storing accompaniment data;

an input for receiving performance data; and a computing circuit for calculating a ratio of the tempo of the received performance to the tempo of the stored performance and for adjusting the tempo of the accompaniment, wherein the program step for the taking of a mean comprises a program step for the taking of a weighted mean.

21. An apparatus for synchronizing a musical accompaniment to a performance comprising:

data storage for storing performance data;

data storage for storing accompaniment data;

an input for receiving performance data;

a computing circuit for calculating a ratio of the tempo of the received performance to the tempo of the stored performance and for adjusting the tempo of the accompaniment, wherein the computing circuit for calculating a ratio between the tempo of the received performance data and the tempo of the stored performance data further comprises:

a computing element; and a program comprising the steps of:

determining a first time period required for a recital of a given segment of the received performance data;

determining a second time period required for a performance of said given segment of the performance data;

dividing the first time period by the second time period;

wherein the program step for determining a first time period for a recital of a given segment of the received performance data comprises:

a computing element; and a program having a step for determining a first time period required for a performance of a bar of music.

22. An apparatus for synchronizing a musical accompaniment to a performance comprising:

data storage for storing performance data;

data storage for storing accompaniment data;

an input for receiving performance data;

a computing circuit for calculating a ratio of the tempo of the received performance to the tempo of the stored performance and for adjusting the tempo of the accompaniment;

wherein the computing circuit for calculating a ratio of the tempo of the received performance data to the tempo of the stored performance data comprises:

a computing element; and a program comprising the steps of:

determining a first amount of received data recited for a given time;

determining a second amount of performance data performed for said given time;

dividing the first amount by the second amount to obtain a ratio;

adjusting the tempo of the accompaniment in proportion to the ratio; and wherein the program step for determining a first time period required for a performance of a given segment of the performance further comprises a program step for determining the a first time period required for performance of four successive notes.

23. An apparatus for synchronizing a musical accompaniment to a performance comprising:

data storage for storing performance data;

data storage for storing accompaniment data;

an input for receiving performance data;

a computing circuit for calculating a ratio of the tempo of the received performance to the tempo of the stored performance and for adjusting the tempo of the accompaniment;

wherein the computing circuit for calculating a ratio of the tempo of the received performance data to the tempo of the stored performance data comprises:

a computing element; and a program comprising the steps of:

determining a first amount of received data recited for a given time;

determining a second amount of performance data performed for said given time;

dividing the first amount by the second amount to obtain a ratio; and adjusting the tempo of the accompaniment in proportion to the ratio, wherein the program step for determining a second time period required for a recital of said given segment of the received performance further comprises a program step which determines time required to receive the data of four successive notes.

24. An apparatus as in claim 23 wherein the four successive notes comprise the four most recently received notes.

25. An apparatus as in claim 23 wherein the program step for calculating a ratio between the tempo of the stored performance data and the tempo of the received performance data further comprises:

determining a first—PT1, second—PT2, third PT3 and fourth PT4 stored performance data representing times of successive notes of the stored performance data;

matching the first—PT1, second—PT2, third PT3 and fourth PT4 times to equivalent first—KT1, second—KT2, third—KT3 and forth—KT4 received performance times; and setting the ratio of the tempo of the received performance data to the tempo of the stored performance= [(KT1–KT2)/(PT1–PT2)+(KT2–KT3)/(PT2–PT3)+(KT3–KT4)/(PT3–PT4)]/3.

26. An apparatus as in claim 23 wherein the program step for calculating a ratio between the tempo of the stored performance and the tempo of the received performance further comprises:

providing a first—PT1, second—PT2, third PT3 and fourth PT4 stored performance data representing successive performance times of the stored performance data;

matching the first—Pt1, second—PT2, third PT3 and fourth PT4 stored performance times to equivalent first—KT1, second—KT2, thrid—KT3 and forth—KT4 received performance times;

setting the ratio of the temp of the received performance data to the tempo of the stored performance= (KT1–KT4)/(PT1–PT4).

27. An apparatus for synchronizing a musical accompaniment to a performance comprising:

data storage for storing performance data;

data storage for storing accompaniment data;

an input for receiving performance data;

a computing circuit for calculating a ratio of the tempo of the received performance to the tempo of the stored performance and for adjusting the tempo of the accompaniment;

wherein the computing circuit for calculating a ratio of the tempo of the received performance data to the tempo of the stored performance data comprises:

a computing element; and a program comprising the steps of:

selecting a time interval;

determining a first amount of received data recited for a given time by determining the amount of received performance data (Rd) in the interval;

determining a second amount of performance data performed for said given time by determining the amount of stored performance data (Pd) that corresponds to the time interval;

dividing the first amount by the second amount to obtain a ratio by setting the ratio of the tempo of the received performance data to the tempo of the stored performance=Rd/Pd; and adjusting the tempo of the accompaniment in proportion to the ratio.

* * * * *